US005870120A

United States Patent [19]

Terai

[11] Patent Number: 5,870,120

[45] Date of Patent: Feb. 9, 1999

[54] INK JET HEAD BASE BODY, INK JET HEAD USING SAID BASE BODY, AND METHOD FOR FABRICATING SAID BASE BODY AND SAID HEAD

[75] Inventor: Haruhiko Terai, Yokohama, Japan

[73] Assignee: Canon Kabushiki Kaisha, Tokyo, Japan

[21] Appl. No.: 643,561

[22] Filed: May 6, 1996

Related U.S. Application Data

[63] Continuation of Ser. No. 235,786, Apr. 29, 1994, abandoned.

[30] Foreign Application Priority Data

Apr. 30, 1993 [JP] Japan ..... 5-104070

[51] Int. Cl.[6] ..... B41J 2/005

[52] U.S. Cl. ..... 347/56; 347/67; 29/593; 29/890.1

[58] Field of Search ..... 347/19, 56, 59, 347/61, 63, 67; 29/593.611, 890.1; 156/630

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,364,010 | 12/1982 | Watari et al. | 324/158 T |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,608,577 | 8/1986 | Hori | 347/66 |
| 4,723,129 | 2/1988 | Endo et al. | 347/45 |
| 4,740,796 | 4/1988 | Endo et al. | 347/56 |
| 4,878,992 | 11/1989 | Campanelli | 156/633 |
| 5,049,231 | 9/1991 | Shibata | 156/630 |

FOREIGN PATENT DOCUMENTS

| | | |
|---|---|---|
| 0197723 | 10/1986 | European Pat. Off. . |
| 0389296 | 9/1990 | European Pat. Off. . |
| 4-255361 | 9/1992 | Japan . |
| 5-31906 | 2/1993 | Japan . |
| 5-31918 | 2/1993 | Japan . |
| 5-64890 | 3/1993 | Japan . |

*Primary Examiner*—Benjamin R. Fuller
*Assistant Examiner*—Craig A. Hallacher
*Attorney, Agent, or Firm*—Fitzpatrick, Cella, Harper & Scinto

[57] ABSTRACT

An ink jet head base body has arranged thereon a plurality of electricity-heat converters having a substrate, heat generating resistors provided on the substrate, and electrodes electrically connected to the heat generating resistors. The cutting line is provided between the plural electricity-heat converters, and the monitors for the quality confirmation are disposed on the cutting line.

8 Claims, 7 Drawing Sheets

INK JET HEAD BASE BODY, INK JET HEAD USING SAID BASE BODY, AND METHOD FOR FABRICATING SAID BASE BODY AND SAID HEAD

This application is a continuation of application Ser. No. 08/235,786 filed Apr. 29, 1994, and now abandoned.

BACKGROUND OF THE INVENTION

1. Field of the Invention

The present invention relates to an ink jet head base body having arranged thereon a number of electricity-heat converters on a support member (substrate) and an ink jet head using said base body, as well as a method for fabricating said base body and said head.

2. Related Background Art

Typically, among ink jet heads, the construction of an ink jet head of the type where a number of electricity-heat converters are provided on a substrate is provided on the substrate 1 with a heat generating resistance layer 2 containing heat generating resistors 2*a* as heat energy generators for generating heat energy to be acted on the liquid and an electrode layer 3 for applying voltage to said heat generating resistors, as shown in FIGS. 3A and 3B. Also, a protective layer 4 is provided, as required, on the electricity-heat converters comprised of the heat generating resistance layer 2 and the electrode layer 3.

An ink jet head is constructed in such a way as to bond a ceiling plate having grooves onto such substrate, each groove serving to form an orifice (discharge opening) 7 through which liquid is discharged and a liquid channel 6 communicating with said orifice 7 and provided at a site corresponding to said heat generating resistor 2*a*. Conventionally, an ink jet head was obtained by preparing electricity-heat converters corresponding to a plurality of ink jet heads on an Si wafer which is a substrate, and cutting and separating the Si wafer after bonding such a ceiling plate to the Si wafer.

Herein, a base body 8 can be obtained by laminating at least an electrode layer 3 and a heat generating resistance layer 2 on a substrate 1, patterning them into a predetermined shape, and forming heat generating resistors 2*a* electrically connected to a pair of electrodes 3*a*, 3*b* spaced apart a predetermined interval, as shown in FIGS. 4A and 4B.

And the electrode layer 3 and the heat generating resistance layer 2 are formed by thin film forming technology such as sputtering which may be utilized in the semiconductor fields.

On the other hand, such base bodies have been made in larger sizes in recent years, aiming at reducing the costs due to improvement of the through-put. Along with the larger base body, the substrate is changed in shape from round to rectangular substrate. That is, the round Si substrate currently available is limited in size up to as large as 8 inches in diameter, because if an integral-type ink jet head having the print width beyond that limit size is to be fabricated, the substrate is obliged to be a rectangular substrate which is fabricated by cutting an Si ingot in regular grain. Also, if the substrate is made larger in this way, there is often seen a dispersion in quality such as film thickness dispersion in the above-mentioned thin film forming technology.

Thus, in order to check and manage a variety of qualities in the manufacturing process of such base plates 8, the manufacturers have been involved in providing monitors such as a specific resistance measuring monitor $\mathbf{1}d_1$, a film thickness measuring monitor $\mathbf{1}d_2$, and an adhesion strength measuring monitor $\mathbf{1}d_3$ on a part of the base body 8 on which a base body portion 1*a* corresponding to one of a plurality of ink jet heads is disposed, to measure properties of the base body such as the film thickness of each layer, resistance of heat generating resistance layer, and film adhesion strength, as shown in FIG. 2.

However, when the substrate is rectangular, because by cutting a rectangular base body, as previously described, monitors will be disposed in the effective portion, thus reducing the number of pieces to be taken.

Also, to enhance the print quality, it is necessary to arrange more monitors for the quality management as described above as the substrate is larger, and as a greater number of monitors are provided, the number of ink jet heads produced per substrate is further reduced, resulting in an increase in cost. If the monitor is reduced in size, the measurement may become impossible, or the measurement accuracy may be remarkably degraded, rather resulting in the lower yield.

SUMMARY OF THE INVENTION

An object of the present invention is to resolve the aforementioned problems with the conventional art and provide an ink jet head of high print quality with good yield and cheaply.

It is another object of the present invention to provide a highly reliable ink jet head base body and an ink jet head using said base body, with lower costs, without requiring any special space for the monitor within the base body.

DETAILED DESCRIPTION OF THE PREFERRED EMBODIMENTS

This invention will be described below on the basis of the embodiments.

Figure 5:
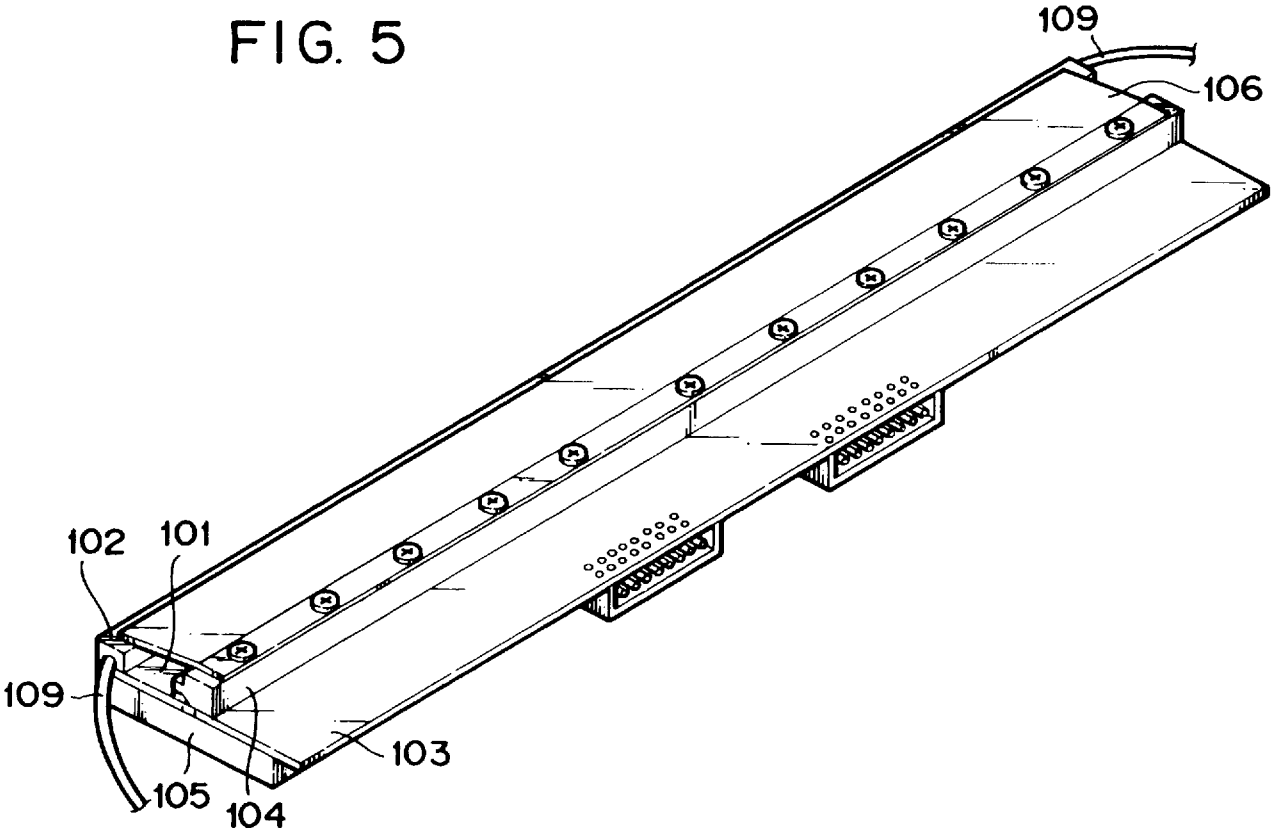
FIG. 5 is a typical perspective view of an ink jet head suitable for the present invention.

First, there is shown in FIG. 5 an embodiment of an ink jet head suitable for the present invention.

The ink jet recording head as shown in FIG. 5 is an ink jet recording head of the so-called full line type, having arranged discharge orifices over the length corresponding to one side of the recording sheet of A4 size, for example.

In this figure, 101 is a heater board composed of Si, on the upper plane of which are provided a plurality of electricity-heat converters as discharge energy generating elements and electrode wirings for supplying electric power thereto (both not shown). 102 is a ceiling plate made of glass or metal, which is formed with an ink inlet port for introducing the recording liquid such as ink (hereinafter referred to as ink) and a concave portion for a common liquid chamber communicating with each ink flow passage as well as reserving the ink introduced, by cutting or etching. Note that 109 is an ink supply tube connecting to the inlet port.

Herein, each ink flow passage is formed in a solid layer 108 corresponding to each discharge energy generating element of a heater board 101. The ceiling plate 102 is bonded onto the solid layer, and the heater board 101 is adhesively secured to a base plate 105. An electrically connecting pad for the heater board 101 and an electrically connecting pad for a flexible substrate 103 are aligned, and a pressing member 104 for pressing the flexible substrate 103 to the base plate 105 is screwed to the base plate 105. Thereby, the heater board 101 and the flexible substrate 103 are mechanically joined. On the upper part of the pressing member is secured one end portion of a presser leaf spring 106 by means of a screw, the other end portion thereof abutting against and pressing resiliently on the upper plane of the ceiling plate 102. Thereby, the ceiling plate 102 is mechanically urged against the heater board 101.

Figure 1:
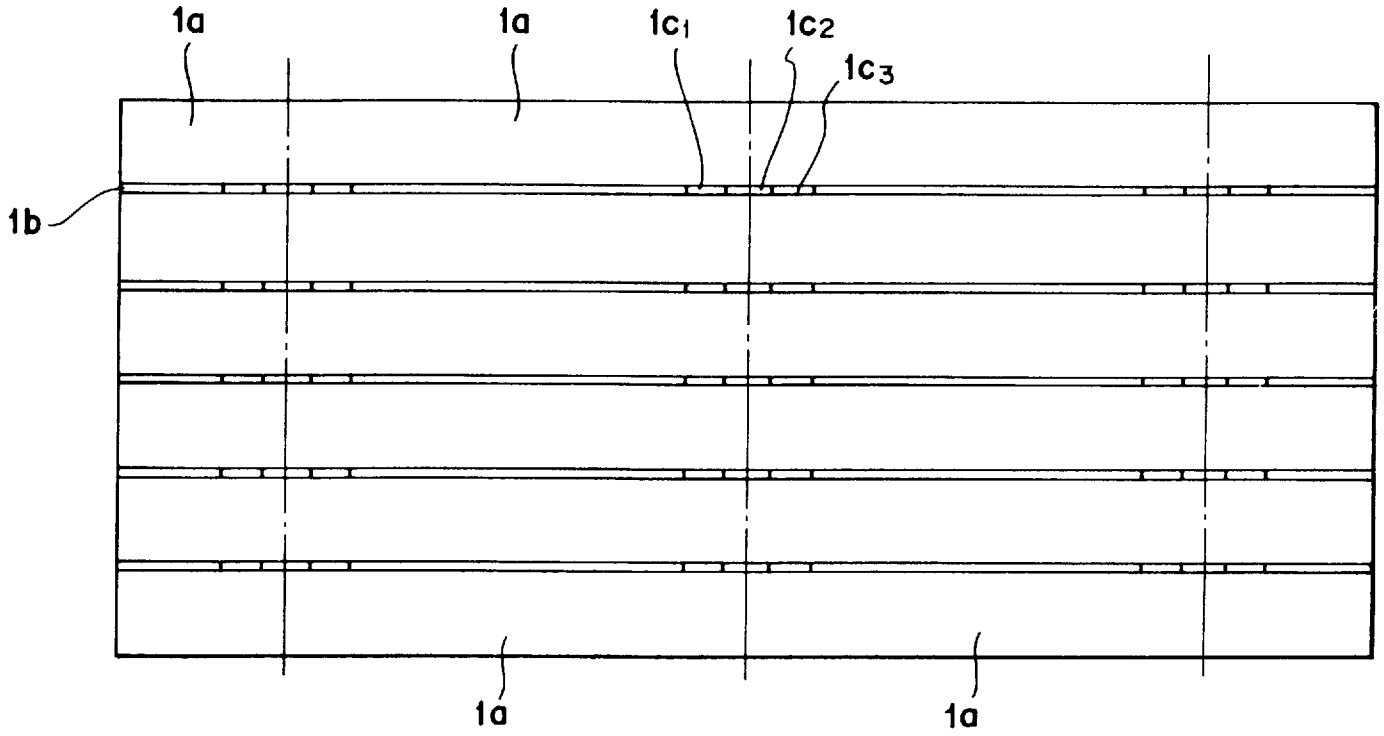
FIG. 1 is an explanatory view of the present invention for making an ink jet recording head base body with a rectangular substrate, disposing monitors in the cutting portion, and cutting and separating the head base body.

An embodiment of a base body which is an essential part of the present invention is shown in FIG. 1.

Figure 2:
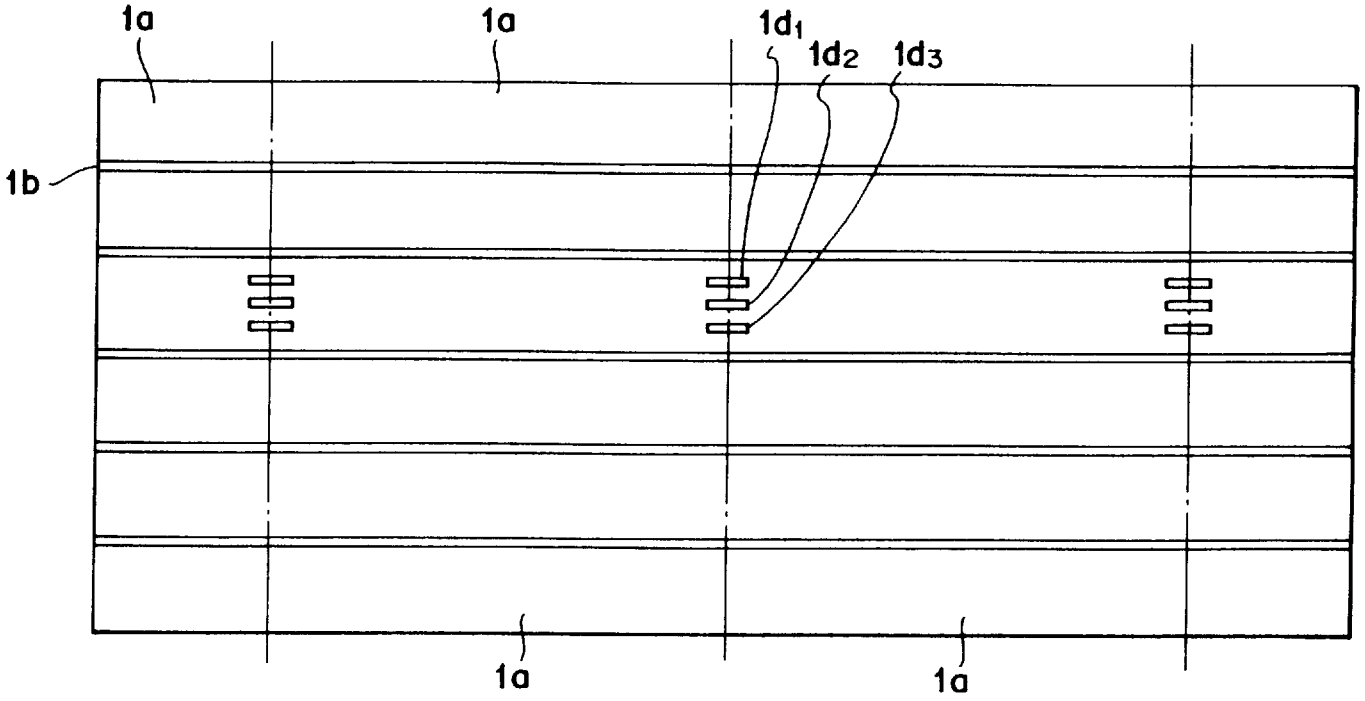
FIG. 2 is an explanatory view in which the head base body is cut and separated in the conventional monitor arrangement.
Figure 3A:
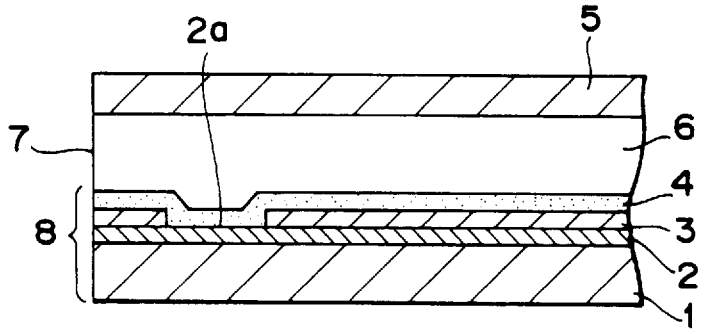
FIG. 3A is a cross-sectional view of an ink jet recording head along the flow passage in the main part thereof.
Figure 3B:
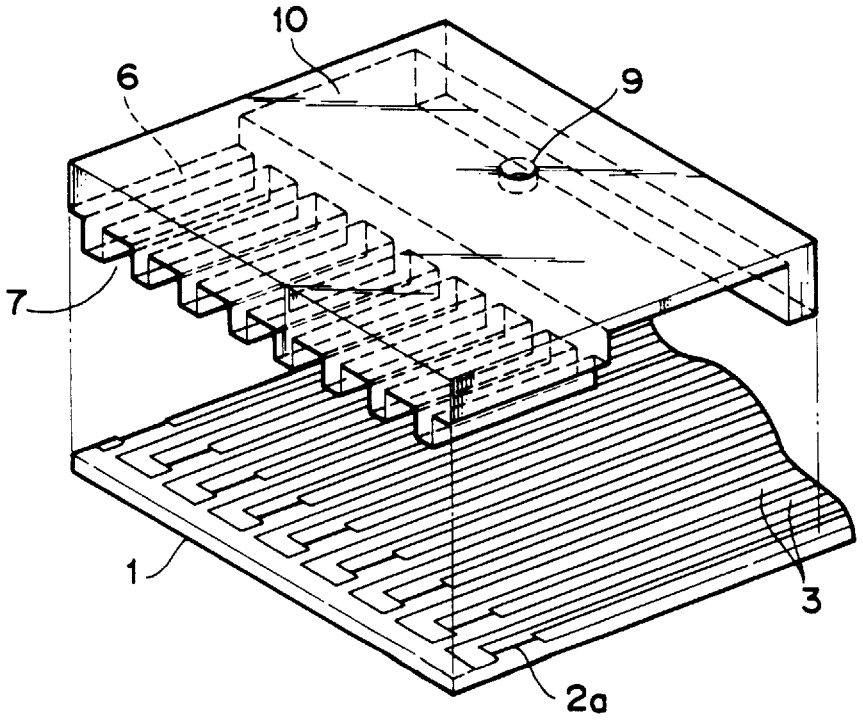
FIG. 3B is an exploded perspective view thereof.

FIG. 1 is an explanation view of this embodiment of the present invention for making an ink jet head base body from a rectangular substrate, disposing monitors in the cutting portion, and cutting and separating the head base body. In FIGS. 1 and 2, like numerals are used to refer to like parts. As shown in FIG. 1, a plurality of three types of monitors consisting of a specific resistance measuring monitor $\mathbf{1}c_1$, a film thickness measuring monitor $\mathbf{1}c_2$ and an adhesion strength measuring monitor $\mathbf{1}c_3$ are disposed on the cutting portion 1*b* in this embodiment.

By providing each of monitors in the cutting portion in the above way a, relatively great number of monitors can be disposed, without necessitating any special space for the monitor within the base body, whereby an ink jet head base body having high print quality, good yield and favorable costs can be provided.

Also, the cutting is performed by rotating a round blade such as a diamond blade or a resin blade at high speed, wherein as the thickness of the substrate is larger, the greater mechanical strength of the blade is necessary, and the blade thickness is thicker.

In the ink jet head, in the case of a large-size substrate, the thickness of substrate is about 2 mm in consideration of the strength of the substrate.

Typically, when the substrate thickness is 2 mm, the blade thickness is required to be about 2 mm. On the other hand, the dimension of monitor is necessary to be as large as about 2×10 (mm), although there is some difference with its function. Hence, it will be found that the monitors can be fully placed within the cutting width.

The monitor will be further explained below. The monitor is divided by its function into three main portions as above mentioned: that is, a specific resistance measuring monitor, a film thickness measuring monitor and an adhesion strength measuring monitor.

The specific resistance measuring monitor is a portion for measuring the sheet resistance of a heat generating resistance layer on the base body, in which the heat generating resistance layer is patterned into a necessary shape and exposed. Also, by patterning it into the same shape as the heat generating resistor, the resistance of heat generating resistor can be roughly measured.

Figure 7:
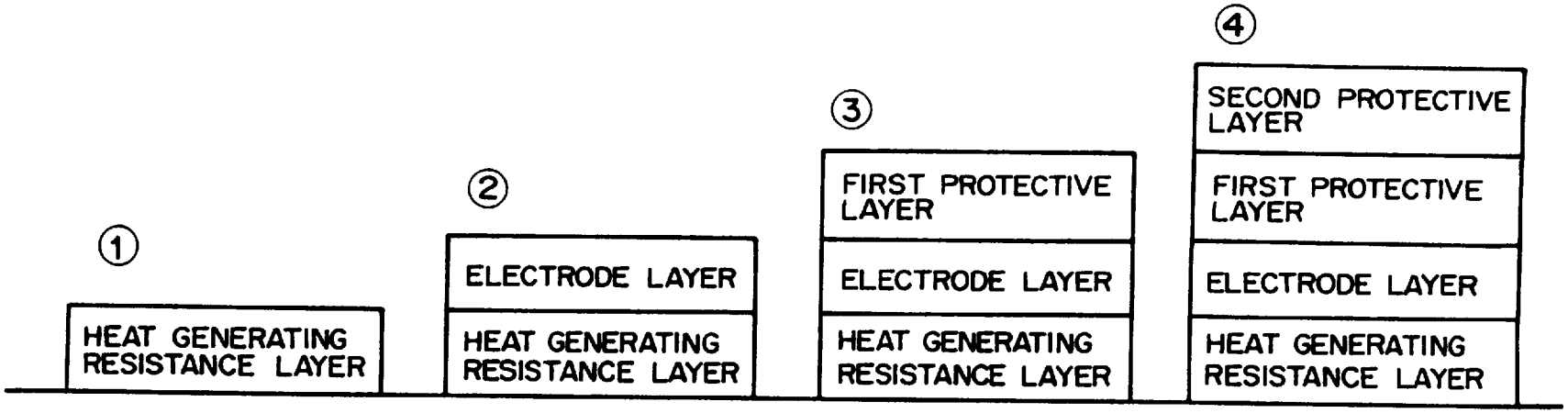
FIG. 7 is an explanatory view showing one constitutional example of a film thickness measuring monitor.

Next, the film thickness measuring monitor is a portion for measuring the film thickness of each thin film such as a heat generating resistance layer, an electrode layer and a protective layer, in which a monitor is formed by laminating in succession from the lower layer as indicated by 1 to 4 in FIG. 7, for example. By subtracting the film thickness of the lower layer from the film thickness of each monitor portion, respective film thicknesses can be measured.

Next, the adhesion strength measuring monitor is a portion for measuring the adhesion strength mainly of the protective layer, in which the patterning is made by dry etching to have a grid 2 mm square of Ta, for example.

The constitution of each monitor is not limited to that as described above, but various constitutions can be adopted as long as the respective objects are attained.

The arrangement of the monitors may be such that three to ten pieces are placed in the longitudinal direction of the base body, depending on the size of the base body.

A fabrication method of this embodiment will be described below.

Figure 4A:
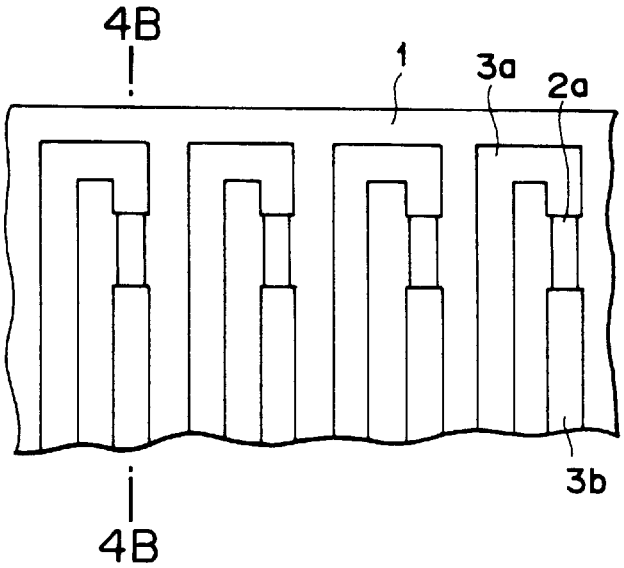
FIG. 4A is a partial plan view of an ink jet recording head base body.
Figure 4B:
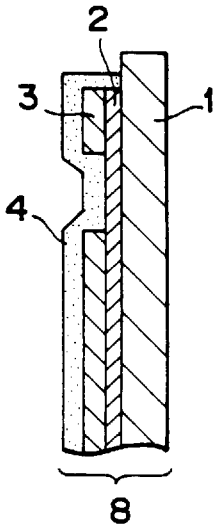
FIG. 4B is a cross-sectional view taken along the line 4B—4B in FIG. 4A.

An ink jet head base body having a number of electricity-heat converters was fabricated using a rectangular Si substrate as large as 300 mm×130 mm×2 mm, as shown in FIGS. 4A and 4B. The dimensions of the base body constituting one ink jet head are 20 mm×300 mm, with the cutting width required to be 2 mm wide. The monitor has such an arrangement that a monitor for the specific resistance measurement of heat generating resistor (necessary space 2 mm×10 mm), $HfB_2$, Al, a monitor for the first protective film, $SiO_2$, Ta, a monitor for the film thickness measurement of photosensitive polyamide (total necessary space 2 mm×10 mm), and a monitor for the adhesion strength measurement (necessary space 2 mm×10 mm) of Ta are disposed on five cutting lines each divided into six equal parts in the longitudinal direction. Six heads could be obtained from one substrate by accommodating the monitors within the cutting width.

More particularly, first, a 3 $\mu$m thick $SiO_2$ film was formed by thermal oxidation on the surface of the Si substrate. Then, the heat generating resistor $HfB_2$ was sputtered 1500 Å thick, using the sputtering method, and further, Al for the wiring layer was sputtered 5000 Å thick. Then, the patterning was made into a heat generating resistor shape and electrode shape to have the monitor, using the photolithography method, as shown in FIGS. 4A and 4B. In this patterning formation, the arrangement of the head base body and the arrangement of the monitor as previously presented were followed.

Then, the protective film $SiO_2$ was deposited 2 $\mu$m thick by bias sputtering. Further, the second protective film Ta was sputtered and patterned according to the same rule using the photolithography method and dry etching method. And finally, photosensitive polyamide was likewise patterned to fabricate an ink jet head base body.

Then, the specific resistance of heat generating resistor, the film thickness of each layer, and the adhesion strength of Ta film were measured by the monitor.

It should be noted that these measurements were conducted by using a four-probe resistance measuring instrument in the specific resistance measurement, a tracer type film thickness measuring instrument in the measurement of the film thickness, and a peel test by adhesive tape in the measurement of the adhesion strength, respectively. And after confirming that each measured value is within the specification, liquid channels composed of a cured layer of epoxy resin and walls for such liquid channels were formed by the photolithography method, and a ceiling plate was bonded thereto.

Then, by cutting and separating the head base body into head units along the cutting line by means of a diamond blade, ink jet heads were obtained.

To the contrary, in the conventional monitor arranging method as shown in FIG. 2, only five heads can be obtained from a substrate of the same size, with only three monitor positions in the longitudinal direction of the substrate, and the quality distribution information of each layer in the transverse direction of the substrate is one-half or less that of the method according to this embodiment.

As above described, according to the present invention, the number of heads to be taken from one substrate can be increased, thereby reducing the costs, and the monitors can be disposed in the broader range, with the quality distribution information of each layer up increased, whereby more reliable ink jet heads can be produced.

Figure 6:
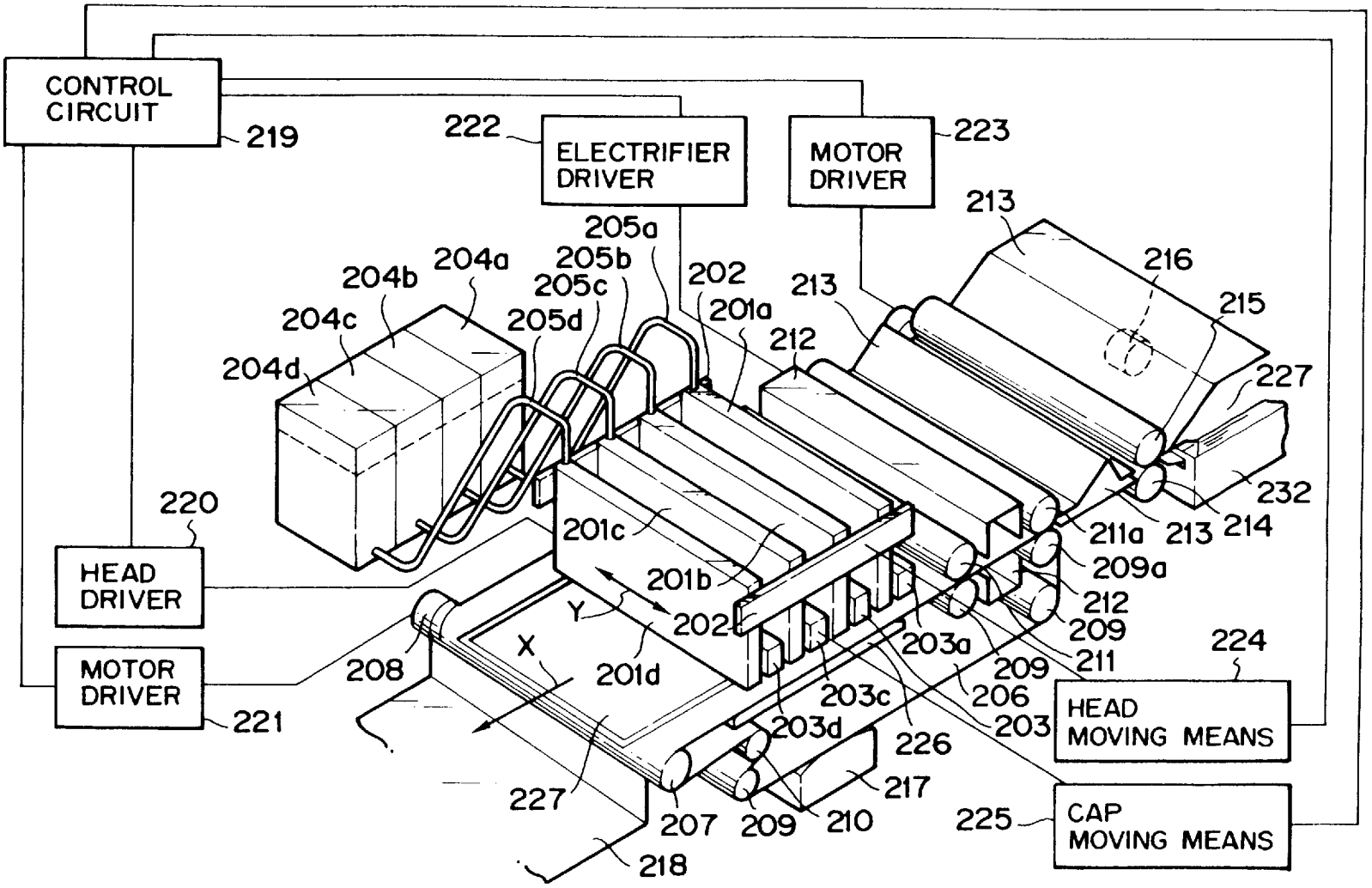
FIG. 6 is a typical perspective view of an ink jet apparatus on which an ink jet head of the present invention is mountable.

FIG. 6 shows one embodiment of an ink jet device on which an ink jet head of this embodiment is mounted.

In the figure, 201*a* to 201*d* are line-type heads, and are securely supported in parallel within a holder 202, spaced apart by a predetermined interval from each other in the X direction. On the lower plane of each of heads 201*a* to 201*d,* there are provided 3456 discharge orifices, directed downward, along the Y direction at a density of 16 discharge orifices/mm in one column, whereby the recording can be effected in a width of 216 mm.

These heads 201*a* to 201*d* rely on a method of discharging the recording liquid using heat energy, in which the discharge is controlled by a head driver 20.

It should be noted that a head unit is constituted of the heads 201*a* to 201*d* and the holder 202, wherein the head unit is movable vertically by head moving means 224.

Also, 203*a* to 203*d* are head caps disposed corresponding to the heads 201*a* to 201*d* and adjacent the lower portion thereof. Each cap has an ink absorbing member such as a sponge inside.

It should be noted that the caps are securely supported by a holder, not shown, and a cap unit is constituted of the holder and the caps 203*a* to 203*d,* the cap unit being movable in the X direction by cap moving means 225.

The heads 201*a* to 201*d* are supplied with the inks of respective colors of cyan, magenta, yellow and black through the ink supply tubes 205*a* to 205*d* from the ink tanks 204*a* to 204*d,* respectively, thereby making the color recording possible.

Also, the ink supply is performed using the capillary phenomenon of head discharge orifices, wherein the liquid level of each ink tank is set to be a certain distance below the discharge orifice position.

206 is an electrifiable seamless belt for conveying the recording sheet 227 which is the recording medium.

That belt 206 is drawn around a predetermined passage by a drive roller 207, idler rollers 209, 209*a,* and a tension roller 210, and connected to the drive roller 207 to be run by a belt drive motor 208 which is driven by a motor driver 221.

Also, the belt 206 is run directly below the discharge orifices 201*a* to 201*d* in the X direction, wherein its deflection to the lower side is suppressed by means of a securing support member 226.

217 is a cleaning unit for removing paper powder sticking to the surface of the belt 206.

212 is an electrifier for electrifying the belt 206, which is turned on or off by an electrifier driver 222, wherein the recording sheet is adsorbed to the belt owing to electrostatic adsorption force with this electrification.

In front of and behind the electrifier 212 are disposed pinch rollers 211, 211 for pressing the recording sheet 227 to be conveyed onto the belt 206 in cooperation with the idler rollers 209, 209*a.*

232 is a sheet supply cassette, recording sheets 226 within the cassette are fed one by one owing to the rotation of a sheet supply roller 216 to be driven by a motor driver 223, and conveyed in the X direction by a conveying roller 214 which is driven by the same driver 223 and a pinch roller 215 to an angled guide 213.

The guide has a angled space which allows for the flexure of the recording sheet.

218 is a sheet exhaust tray into which the recording sheet completed with the recording is exhausted.

The head driver 220, the head moving means 224, the cap moving means 225, the motor drivers 221, 223, and the electrifier driver 222 are all controlled by a control circuit 219.

The present invention brings about excellent effects particularly in an ink jet head or ink jet device which outputs the image by forming flying fine liquid droplets by the use of heat energy among the various ink jet recording systems.

As to its representative constitution and principle, for example, one practiced by use of the basic principle disclosed in, for example, U.S. Pat. Nos. 4,723,129 and 4,740,796 is preferred. This system is applicable to either of the so-called on-demand type and the continuous type. Particularly, the case of the on-demand type is effective because, by applying at least one driving signal which gives rapid temperature elevation exceeding nucleus boiling corresponding to the recording information on electricity-heat converters arranged corresponding to the sheets or liquid channels holding a liquid (ink), heat energy is generated at the electricity-heat converters to effect film boiling at the heat acting surface of the recording head, and consequently the bubbles within the liquid (ink) can be formed corresponding one by one to the driving signals. By discharging the liquid (ink) through an opening for discharging by growth and shrinkage of the bubble, at least one droplet is formed. By making the driving signals into the pulse shapes, growth and shrinkage of the bubbles can be effected instantly and adequately to accomplish more preferably discharging of the liquid (ink) particularly excellent in response characteristic.

As the driving signals of such pulse shape, those as disclosed in U.S. Pat. Nos. 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

As the constitution of the ink jet head, in addition to the combination of the discharging orifice, liquid channel, and electricity-heat converter (linear liquid channel or right-angled liquid channel) as disclosed in the above-mentioned respective specifications, the constitution by use of U.S. Pat. Nos. 4,558,333 or 4,459,600 disclosing the constitution having the heat acting portion arranged in the flexed region is also included in the present invention.

In addition, the present invention can be also effectively made the constitution as disclosed in Japanese Laid-Open Patent Application No.59-123670 which discloses the constitution using a slit common to a plurality of electricity-heat converters as the discharging portion of the electricity-heat converter or Japanese Laid-Open Patent Application No.59-138461 which discloses the constitution having the opening for absorbing pressure wave of heat energy correspondent to the discharging portion.

Further, as the ink jet head of the full line type having a length corresponding to the maximum width of recording medium which can be recorded by the ink jet device, the present invention can exhibit the effects as described above further effectively with either the constitution which satisfies its length by the combination of a plurality of recording heads as disclosed in the above-cited specifications or the constitution as one ink jet head integrally formed.

In addition, the present invention is effective for an ink jet head of the freely exchangeable chip type which enables electrical connection to the main device or supply of ink from the main device by being mounted on the main device, or an ink jet head of the cartridge type having an ink tank integrally provided on the ink jet head itself.

Also, addition of a restoration means for the ink jet head, a preliminary auxiliary means, etc., provided as the constitution of the ink jet device of the present invention is preferable, because the effect of the present invention can be further stabilized. Specific examples of these may include, for the ink jet head, capping means, cleaning means, pressurization or suction means, electricity-heat converters or another type of heating elements, or preliminary heating means according to the combination of these, and it is also effective for performing stable recording to perform preliminary mode which performs discharging separate from recording.

Furthermore, as the recording mode of the ink jet device, the present invention is extremely effective for not only the recording mode only of a primary color such as black, etc., but also a device equipped with at least one of plural different colors or full color by color mixing, whether the ink jet head may be either integrally constituted or combined in plural number.

Though the ink is considered as the liquid in the embodiments of the present invention as above described, another ink can be also used which is solid below room temperature and will soften or liquefy at or above room temperature, or liquefy when a usable recording signal is issued as it is common with the ink jet system to control the viscosity of ink to be maintained within a certain range of the stable discharge by adjusting the temperature of ink itself in a range from 30° C. to 70° C.

In addition, in order to avoid the temperature elevation due to heat energy by positively utilizing the heat energy as the energy for the change of state from solid to liquid, or to prevent the evaporation of ink by using the ink which will stiffen in the shelf state, the use of the ink having a property of liquefying only with the application of heat energy, such as liquefying with the application of heat energy in accordance with a recording signal so that liquid ink is discharged, or may already solidify prior to reaching the recording medium, is also applicable in the present invention. In such cases, the ink may be held as liquid or solid in recesses or through holes of a porous sheet, which is placed opposed to electricity-heat converters, as described in Japanese Laid-Open Patent Application No. 54-56847 or No. 60-71260. The most effective method for the ink as above described in the present invention is based on the film boiling.

Additionally, the ink jet device according to the present invention may take the form of an image output terminal for the information processing equipment such as a word processor or computer, which is provided integrally or separately, a copying machine in combination with the reader, or a facsimile terminal equipment having the transmission and reception feature.

What is claimed is:

1. An ink jet head body, comprising:

a substrate;

a plurality of electricity-heat converters disposed on said substrate and having a cutting line located between some of said electricity-heat converters;

a plurality of heat generating resistors disposed on said substrate; and a plurality of electrodes electrically connected to said heat generating resistors; and a plurality of monitors for quality confirmation, said monitors being fully disposed within a cutting width of said cutting line.

2. An ink jet head body according to claim 1, further comprising:

a plurality of discharge orifices through which an ink is discharged; and a plurality of liquid channels communicating with said discharge orifices, wherein said discharge orifices and said liquid channels are formed at positions corresponding to said heat generating resistors of said ink jet head body.

3. An ink jet head body according to claim 2, wherein said ink let head body is of a full line type in which said discharge orifices are provided across an entire width of a recording area of a recording medium.

4. A method for fabricating ink jet head bodies, comprising the steps of:

providing a substrate having arranged thereon a plurality of electricity-heat converters, with a cutting line located between some of said electricity-heat converters, a plurality of heat generating resistors provided on said substrate, a plurality of electrodes electrically connected to said heat generating resistors, and a plurality of monitors for quality confirmation, said monitors being fully disposed within a cutting width of said cutting line;

confirming at least one quality of said ink jet head base bodies through said monitors;

cutting said substrate;

separating said substrate to obtain individual said ink jet head bodies, wherein the cutting and the separating are effected after the confirming of respective qualities through said monitors.

5. A method for fabricating ink jet head bodies according to claim 4, further comprising the step of forming said monitors simultaneously with said electricity-heat converters.

6. A method for fabricating ink jet head bodies according to claim 4, further comprising the step of forming a plurality of discharge orifices through which an ink is discharged and a plurality of liquid channels communicating with said discharge orifices at positions corresponding to positions of said heat generating resistors.

7. A method for fabricating ink jet head bodies according to claim 4, wherein said substrate is a rectangular substrate.

8. A method for fabricating ink jet head bodies according to claim 6, wherein said substrate is a rectangular substrate.

* * * * *

UNITED STATES PATENT AND TRADEMARK OFFICE

CERTIFICATE OF CORRECTION

PATENT NO. : 5,870,120

DATED : February 9, 1999

INVENTOR(S) : HARUHIKO TERAI

It is certified that error appears in the above-identified patent and that said Letters Patent is hereby corrected as shown below:

COLUMN 1

Line 35, "an" should read --such an--.

COLUMN 2

Line 9, "because" should read --because no waste portion is produced--.

COLUMN 5

Line 23, "up" should be deleted.

COLUMN 6

Line 10, "211" (second occurrence) should read --211a--.
Line 19, "a angled" should read --an angled--.

UNITED STATES PATENT AND TRADEMARK OFFICE

CERTIFICATE OF CORRECTION

PATENT NO. : 5,870,120

DATED : February 9, 1999

INVENTOR(S) : HARUHIKO TERAI

It is certified that error appears in the above-identified patent and that said Letters Patent is hereby corrected as shown below:

COLUMN 8

Line 10, "line located" should read --line disposed on said substrate located--.
Line 30, "let" should read --jet--.

Signed and Sealed this

Seventh Day of December, 1999

*Attest:*

Q. TODD DICKINSON

*Attesting Officer*

*Acting Commissioner of Patents and Trademarks*